US005884376A

United States Patent [19]

Bertoldo

[11] Patent Number: 5,884,376

[45] Date of Patent: Mar. 23, 1999

[54] EXPANDING DEVICE FOR TUBULAR KNITTED FABRICS

[75] Inventor: Franco Bertoldo, Vicenza, Italy

[73] Assignee: Sperotto Rimar S.p.A, Milan, Italy

[21] Appl. No.: 136,518

[22] Filed: Aug. 19, 1998

[30] Foreign Application Priority Data

Sep. 8, 1997 [IT] Italy ..... M197A2043

[51] Int. Cl.[6] ..... D06C 5/00

[52] U.S. Cl. ..... 26/80; 26/83

[58] Field of Search ..... 26/80, 82, 83, 26/84, 85

[56] References Cited

U.S. PATENT DOCUMENTS

| | | | |
|---|---|---|---|
| 3,175,272 | 3/1965 | Cohn et al. | 26/84 |
| 3,922,765 | 12/1975 | Hogendyk | 26/80 |
| 3,978,557 | 9/1976 | Goodson | 26/84 |
| 4,103,402 | 8/1978 | Frezza | 26/84 |
| 4,473,929 | 10/1984 | Green | 26/80 |
| 4,598,444 | 7/1986 | Diggle, Jr. | 26/84 |
| 4,885,826 | 12/1989 | Strudel | 26/80 |
| 5,594,978 | 1/1997 | Ferraro | 26/83 |

*Primary Examiner*—Amy Vanatta

*Attorney, Agent, or Firm*—Oblon, Spivak, McClelland, Maier & Neustadt, P.C.

[57] ABSTRACT

An expanding device (11) for tubular knitted fabrics (34) comprising a translating unit (12) on which two magnets (17, 17'), two pairs of traction wheels (15, 16, 15', 16') and two lateral expanders (22, 22') are fastened by a plurality of supporting plates (13, 13'), and on which two metal plates or, preferably, two magnets (23, 23') are attached closely facing the magnets (17, 17'); where the lateral expanders (22, 22') are fitted on swiveling pins with four pairs of sliding rollers (26–29, 26'–29') associated with four pairs of guiding belts (30–33, 30'–33') engaged with the traction wheels (15, 16, 15', 16'), so that the lateral expanders (22, 22') become rigidly connected to the translating unit (12) thanks to the force of attraction between the facing magnets (17, 17', 23, 23'); where the lateral expanders (22, 22') each hold two bipolar magnets (24, 25, 24', 25'), and four pairs of magnets or electromagnets (18–21, 18'–21') are fastened to the supporting plates (13, 13').

12 Claims, 3 Drawing Sheets

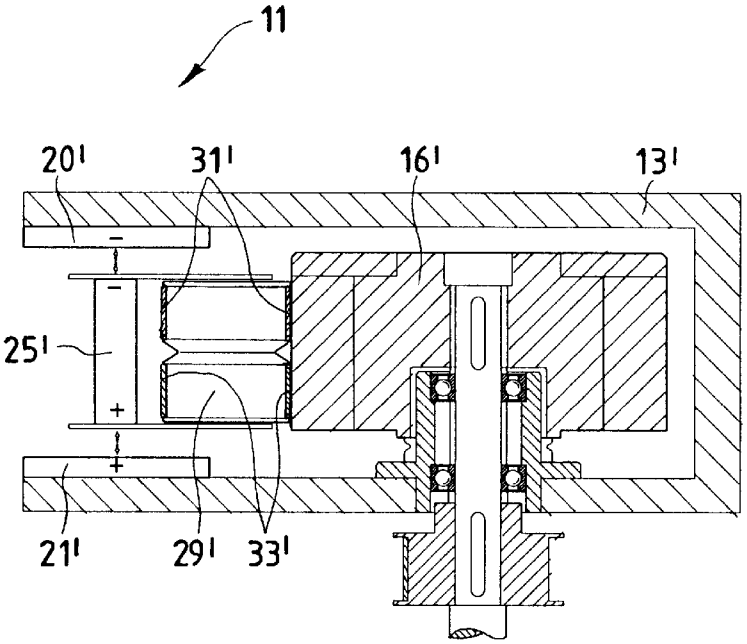
Fig.3
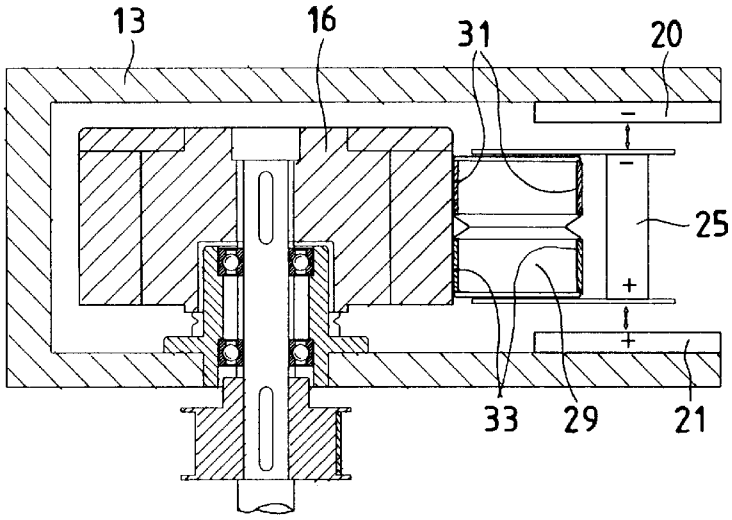

EXPANDING DEVICE FOR TUBULAR KNITTED FABRICS

This invention refers to an expanding device for tubular knitted fabrics.

Expanding devices of various types are used to guide tubular knitted fabrics in textile finishing machines, whose main function is to stretch and adjust the width of the tubular to the most appropriate size commensurate with the characteristics of the knitted fabrics.

Because of the large variety of the fabrics processed, the width of these expanding devices must be capable of being varied and adjusted even when the finishing machine is in use and the fabric is in motion, within the broadest possible range, depending on the specific requirements of the fabric being processed and the working process itself.

The expanding devices equipped with width regulating systems are generally installed between the two lateral arms of the expanding device and based on some manually adjusted, semiautomatic or automatic mechanical principles and elements.

The manual systems involve the manual action of an operator whenever a different adjustment of the width of the expanding device is required, but make it necessary to shut down the finishing machine to disassemble the expanding device from its support in order to vary its width, and to finally reinstall it at a loss of time and production and therefore at increased costs.

The semiautomatic systems manage to overcome the above shortcoming only in part. The practicality of their application is limited in that their field of adjustment is unable to cover the full range of widths typical of the tubular knitted fabrics processed in the textile finishing industry.

As a result, each finishing machine requires the use of one or more expanding devices or of several interchangeable adjusting elements for each expanding device capable of covering a definite and limited range of widths. As soon as the width of the tubular fabrics being processed exceeds the range of widths of the adjusting element installed on it, it is therefore necessary to change the adjusting element inside the expanding device, or to replace the entire device; in any case, this involves shutting down the machine and providing an operator's manual action, with all the ensuing negative consequences in terms of productivity and economics.

The automatic systems are generally produced by rigidly connecting the two lateral arms of the expanding device to their respective translating units, by an interlocking mechanical coupling between the rotating supporting elements held by the translating units and the contoured rotating rings supported by the expanding arms, so as to insert the mentioned contoured rings in their respective supporting elements and thereby achieve a rigid connection between each expanding arm and the respective translating unit.

In this manner, the expanding arms follow their respective translating units in their transversal motions of approaching or spreading each other apart, thus setting up an opening width of the expanding device which is variable and fits the preferred width of the tubular fabric.

However, the lateral edges of the tubular fabric happen to slide along the contact surface between the supporting elements and the contoured rings, as they are forced to follow its alternatively concave and convex path and to suffer the traction and compression strains determined by their interlocking connection.

This generates defects of a permanent nature in the fabric, in the form of deformations and marks.

Another expanding device for automatically adjusted knitted tubular fabrics basically comprises two lateral expanding arms, each of which is rigidly connected to its translating unit by a magnetic field. In particular, a magnet installed in the translating unit exerts a force of attraction on a metallic plate set into the expanding arm, so that the latter is strongly attracted and kept in rigid contact.

The mentioned expanding device nevertheless presents other shortcomings, which negatively affect both its functionality and the quality of the tubular fabric being processed.

In the first place, in order to stabilize the expanding arms coupled to their respective translating units and in particular to prevent the expanding arms, in a horizontally arranged expander, from sliding downward under their own weight while overcoming the magnetic attraction that keeps them attached to the translating units, the traction wheels of these units and the sliding rollers of the expanding arms are engaged in an interlocking fashion by the contours of their respectively concave and convex cone-shaped lateral surfaces.

In this manner, the force of attraction between the translating unit and the expanding arm basically acts along a line extending from the point of contact between the tips of the two conical contours, the lateral edges of the tubular fabric sliding in the space available between the traction wheel and the sliding rollers and along the mentioned contact line in particular. The lateral edges of the tubular fabric therefore suffer a considerable squashing action, which translates to permanent deformations and marks.

In the second place, the connection between the expanding arms and the translating units established along the line of contact between the two conical contours of the respective sliding rollers and the traction wheels renders the expanding arms relatively unstable, with a tendency to oscillate as a result of the outer stresses caused by the fabric and the possibility that the entire expanding device be detached from the translating units in the course of the manufacturing process. To overcome this drawback it is therefore necessary to provide the structure of the expanding device with a greater solidity, by supplying an expandable mechanical organ capable of connecting and maintaining the two lateral expanding arms in a joined position.

On the other hand, this uselessly weighs down the entire expanding device, without serving any active purpose in favor of its operability.

The scope of this invention is therefore to overcome all the mentioned shortcomings and in particular to describe an improved expanding device for knitted tubular fabrics capable of a continuous variation in width.

Another scope of this invention is to produce an expanding device for knitted tubular fabrics capable of a continuous variation in width and free of any limitation in amplitude.

A further scope of this invention is to produce an improved expanding device for knitted tubular fabrics, capable of achieving a translation of the tubular fabric and in particular of its lateral edges, without any traction or compression strains likely to cause permanent deformations and marks.

These scopes are achieved by an improved expanding device for knitted tubular fabrics according to claim 1, which is referred to for brevity.

In an advantageous manner, the device according to this invention allows to use any expandable mechanical organ connecting the lateral expanders to provide stability and solidity to the structure of the device itself, with the resulting advantages in terms of simplifying its construction and operation.

Moreover, it is no longer necessary to provide meshing contours between the translating unit and the lateral expanders in order to ensure the stability and alignement of the lateral expanders, thus avoiding any defects of a permanent deformation and marks on the lateral edges of the tubular fabric caused by the squashing of the mentioned contours.

Finally, the expanding device according to this invention comprises a number of traction wheels and sliding rollers associated with their respective guiding belts having lateral surfaces of a cylindrical profile, so as to be able to discharge and distribute on a broad surface the force of attraction acting between the magnets to establish their mutual connection; the edges of the tubular fabric are therefore subjected to a limited squashing pressure which is uniformly distributed over the entire contact surface.

Further characteristics and advantages of the invention will be more evident in the description of a preferred but not exclusive embodiment of the improved expanding device of tubular knitted fabrics which is the object of this invention, as illustrated in the exemplifying but non limiting example in the simplified accompanying drawings, in which:

FIG. 3 is a cross-section along the line III—III of FIG. 1.

Figure 1:
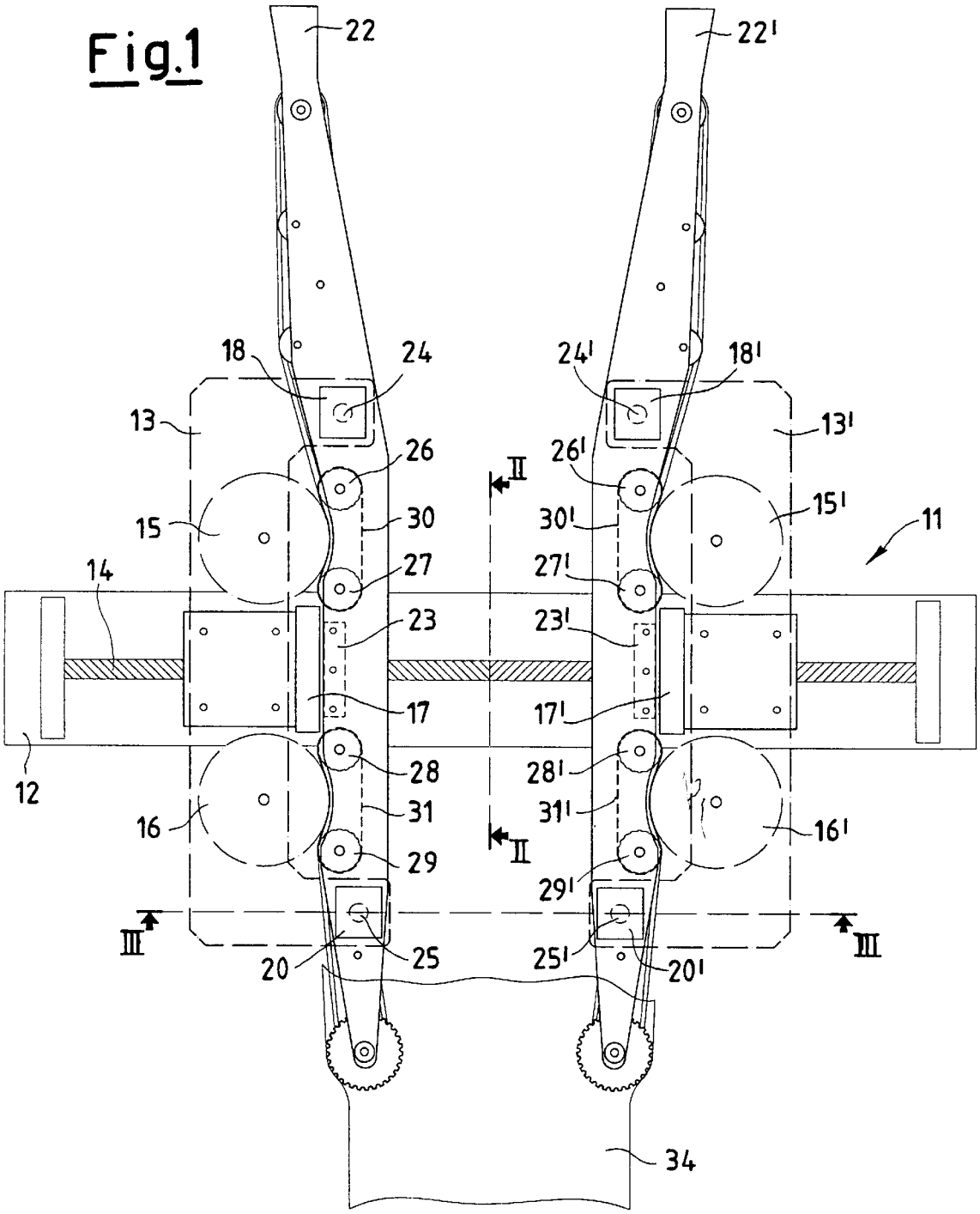
FIG. 1 is a front view of an expanding device according to this invention.
Figure 2:
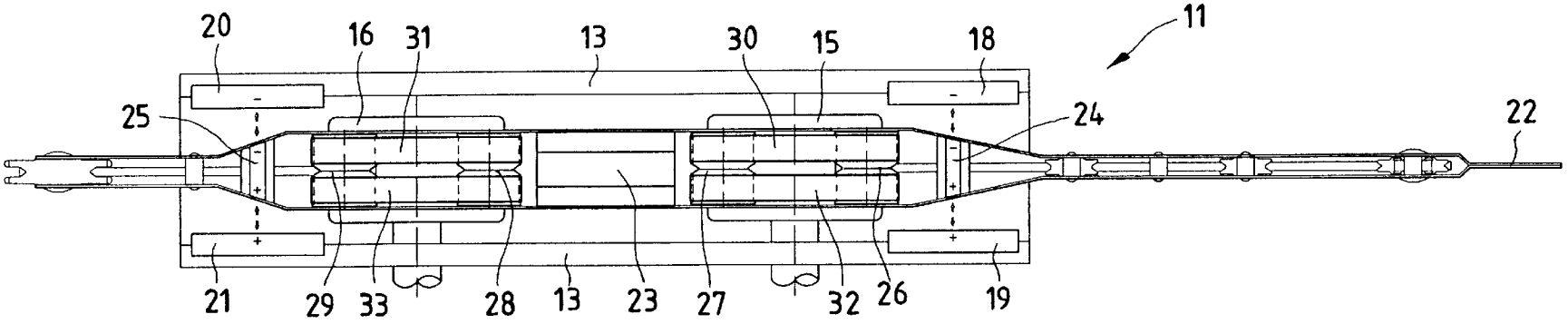
FIG. 2 is a side view of the expanding device according to this invention.

With reference to the mentioned figures, an expanding device for tubular knitted fabrics, according to this invention, is indicated as a whole by the number 11 and comprises a translating unit 12 equipped with two supporting plates 13, 13', capable of being translated by an endless screw 14 fitted with a right and left hand thread, each of said plates 13, 13' being provided with a hinged pair of traction wheels indicated by 15, 16 and 15', 16' respectively, a central magnet 17 and 17' respectively, and two pairs of lateral or superposed magnets or electromagnets, 18, 19, 20, 21 and 18', 19', 20', and 21', respectively.

Two lateral expanders 22, 22' each carry a carbon steel plate 23, 23', or, in a preferred but non-limiting embodiment, a central magnet 23, 23' and two additional bipolar lateral magnets 24, 25 and 24', 25', respectively, and two pairs of hinged swiveling sliding rollers 26, 27, 28, 29, and 26', 27', 28' 29' respectively, having a preferably grooved cylindrical lateral surface. These pairs are associated in their rotation with a preferably toothed guiding belt made of flexible material, indicated by 30, 31 and 30', 31', respectively.

According to a preferred but non limiting embodiment, two toothed and flexible guiding belts are employed, indicated by 30, 32, 31, 33 and 30', 32', 31', 33' respectively.

The two lateral expanders 22, 22' are rigidly connected to the supporting plates 13, 13' of the translating unit 12 by the magnetic fields generated by the interaction between the magnet 17 and the metallic plate or the magnet 23 and between the magnet 17' and the metallic plate or the magnet 23', in a position facing each other at a close distance.

Moreover, the four bipolar magnets 24, 25, and 24', 25' internally arranged on the lateral expanders 22, 22' are with their upper and lower extremities facing the pairs of superposed magnets or electromagnets 18, 19, 20, 21 and 18', 19', 20', 21' respectively, attached to the supporting plates 13, 13' of the translating unit 12, so that the bipolar magnets 24 and 25 are positioned between the upper magnet 18 and the lower magnet 19 and between the upper magnet 20 and the lower magnet 21, respectively, and that the bipolar magnets 24' and 25' are positioned between the upper magnet 18' and the lower magnet 19' and between the upper magnet 20' and the lower magnet 21', respectively. Finally, the traction wheels 15 and 16 are engaged in contact with the guiding belts 30, 32, and 31, 33, respectively, which are associated with the respective sliding rollers 26, 27 and 28, 29 of the lateral expander 22, and the traction wheels 15' and 16' are engaged in contact with the guiding belts 30', 32' and 31', 33', respectively, which are associated with the respective pair of sliding rollers 26', 27' and 28', 29 of the lateral expander 22'. The operation of the expanding device 11 according to this invention is substantially as follows.

The two lateral expanders 22, 22' are applied to the supporting plates 13, 13' of the translating unit 12 by approaching them with their sides holding the metallic plates or magnets 23, 23' fixed to the magnets 17, 17' so as to establish a connection determined by the force of attraction exerted by the interaction between the magnet 17 and the metallic plate or the magnet 23 and between the magnet 17' and the metallic plate or magnet 23', respectively, facing each other in such a manner that the bipolar magnets 24, 25 and 24', 25' are positioned between the pairs of magnets or electromagnets 18, 19, 20, 21, and 18', 19', 20', 21', respectively, whose mutually repelling effect keeps the bipolar magnet 24 at an equal distance from the pair of magnets 18, 19 and the bipolar magnet 25 at an equal distance from the pair of magnets 20, 21 with respect to the lateral expander 22.

The same occurs with the bipolar magnets 24', 25' of the lateral expander 22' with respect to the relative pairs of magnets 18', 19', 20' and 21'.

The guiding belts 30, 32 and 31, 33 associated with the respective pairs of sliding rollers 26, 27 and 28, 29 of the lateral expander 22 thus come to be engaged in contact with the traction wheels 15, 16 on the supporting plate 13 of the translating unit 12, and the same occurs for the corresponding guiding belts 30', 32' and 31', 33' associated with the respective pairs of sliding rollers 26', 27' and 28', 29' of the lateral expander 22', with respect to the corresponding traction wheels 15', 16' on the supporting plate 13' of the translating unit 12. This leads to a rigid connection between the translating unit 12 and the lateral expanders 22, 22'.

The action on a device of any known type, for example of an electromechanical type not shown here, actuates the endless screw 14 and causes a transversal shifting motion to approach or spread the two supporting plates 13, 13' of the translating unit 12 apart from each other, thus regulating the distance between the two lateral expanders 22, 22', which are rigidly connected to them, to the most suitable value in relation to the width of the knitted tubular fabric being processed.

The knitted tubular fabric, generally indicated by 34, is therefore inserted into the expanding unit by using the lateral expanders 22, 22' in the inner part of the same tubular 34, while sliding the lateral edges of the tubular 34 between the guiding belts 30–33, 30'–33', associated with the sliding rollers 26–29, 26'–29' and the traction wheels 15, 16, 15', 16' which are engaged with them.

The feeding of the tubular fabric 34 across the expanding unit 11 occurs as a result of the combined action of the traction wheels 15, 16, 15', 16' and of the sliding rollers 26–29, 26'–29' with their relative guiding belts 30–33, 30'–33'.

Each rotating traction wheel 15, 16, 15', 16' transmits the motion to the guiding belts 30–33, 30'–33', which are in turn set in motion on the sliding rollers 26–29, 26'–29'; the tubular fabric 34 interposed between the traction wheels 15, 16, 15', 16' and the guiding belts 30–33, 30'–33' receives the motion from the traction wheel 15, 16, 15', 16' and is in its motion guided without slippage by the guiding belts 30–33, 30'–33'.

In order to vary the width of the expanding device 11 and adapt it to the changed width of the tubular fabric 34 being processed, it is possible to conveniently vary the distance between the two lateral expanders 22, 22' by acting on the known device causing the transversal shifting of the two supporting plates 13, 13' of the translating unit 12, to which the lateral expanders 22, 22' are rigidly connected.

The connection between the translating unit 12 and the lateral expanders 22, 22' is rigid and stable not only in a transversal and longitudinal direction but above all in a direction perpendicular to the plane of the forward motion of the fabric 34, thanks to the fact that, particularly in the case of a horizontal arrangement of the expanding device 11, the lateral expanders 22, 22' are prevented from shifting in a vertical sense, for example from sliding downward, because of their weight or external forces exerted by the fabric 34, by the repulsing force generated between the pairs of magnets or electromagnets 18–21, 18'–21' attached to the translating unit 12 and the corresponding bipolar magnets 24, 25, 24', 25' set into the expanders 22, 22' themselves, so that any shift of the lateral expander 22, 22' from its centrally aligned position is corrected. This solution allows to eliminate any expandable mechanical organ to connect and hold the two lateral expanders 22, 22' together, so as to provide solidity and stability to the structure of the enlarging device 11, with the resulting advantages in terms of simplifying its construction and operation.

A further advantage of this invention is in that it is no longer necessary to produce interlocking connections between the translating unit 12 and the lateral expanders 22, 22' by applying contours of any shape to the lateral surfaces of the traction wheels 15, 16, 15', 16' and to the sliding rollers 26–29, 26'–29', so as to provide stability and alignement to the lateral expanders 22, 22'. All this prevents any defects such as permanent deformations and marks on the lateral edges of the tubular fabric 34 caused by the smashing pressure applied and concentrated along the line of contact between the mentioned contours.

On the contrary, the expanding device 11 according to the invention is provided with guiding belts 30–33, 30'–33' associated with the sliding rollers 26–29, 26'–29', which allow to discharge and distribute, over their entire broad and flat contact surface with the traction wheels 15, 16, 15', 16', the pressure exerted by the force of attraction which acts between the magnets establishing their mutual connection.

As a consequence, the edges of the tubular fabric 34, which are interposed in sliding contact between the traction wheels 15, 16, 15' 16' and the guiding belts 30–33, 30'–33' associated with the sliding rollers 26–29, 26'–29' are subject to a relatively limited specific squashing pressure, because the latter is uniformly distributed over their entire contact surface with the guiding belts 30–33, 30'–33'.

The above description clearly illustrates the characteristics and the advantages of the expanding device for tubular knitted fabrics which is the object of this invention.

It is evident that an expert in the art may apply numerous variants to the expanding device for tubular knitted fabrics which is the object of this invention, without thereby abandoning the scope of he protection embodied in the invention, and it is likewise evident that in the practical application of the invention the shapes of the illustrated details may differ and the latter may be replaced by others technically equivalent.

I claim:

1. Expanding device for tubular knitted fabrics of a type comprising a translating unit on which two first magnets and two pairs of traction wheels are fastened by a plurality of supporting plates, said translating unit being provided with an endless screw having a right hand and left hand thread, capable of sliding said supporting plates and two lateral expanders, which hold two metallic plates or second magnets closely facing said first magnets and wherein said lateral expanders also carry four hinged swiveling pairs of sliding rollers which are engaged with said traction wheels in such a manner that said lateral expanders become rigidly connected to said translating unit thanks to the force of attraction between said first magnets and said metallic plates or second magnets facing each other, characterized in that each of said pairs of sliding rollers is enveloped in a rotating manner by a guiding belt.

2. Expanding device according to claim 1, characterized in that each of said pairs of sliding rollers is enveloped in a rotating manner by two guiding belts.

3. Expanding device according to claim 1, characterized in that each of said lateral expanders hold at least one bipolar magnet, and that moreover a plurality of pairs of third magnets or electromagnets are fastened to said supporting plates.

4. Expanding device according to claim 3, characterized in that said bipolar magnets are present in a number of two.

5. Expanding device according to claim 3, characterized in that said pairs of third magnets or electromagnets are present in a number of four.

6. Expanding device according to claim 3, characterized in that said pairs of third magnets or electromagnets are positioned in such a manner that a first pair of said bipolar magnets comes to be interposed between at least two pairs of third magnets or electromagnets and that a second pair of said bipolar magnets comes to be interposed between at least two other pairs of third magnets or electromagnets.

7. Expanding device according to claim 6, characterized in that said bipolar magnets carry at their extremities charges of an opposite sign, and that said pairs of third magnets or electromagnets carry charges of a sign equal to that of the respective bipolar magnets they are facing.

8. Expanding device according to claim 7, characterized in that between said bipolar magnets of said lateral expanders and between said pairs of third magnets or electromagnets of said translating unit a force of repulsion arises which keeps said lateral expanders at an equal distance from said translating unit, thus providing said lateral expanders with alignment and stability with respect to said translating unit.

9. Expanding device according to claim 1, characterized in that said traction wheels and said sliding rollers present cylindrical lateral surfaces.

10. Expanding device according to claim 1, characterized in that said sliding rollers present grooved lateral cylindrical surfaces.

11. Expanding device according to claim 1 or 2, characterized in that said guiding belts are toothed.

12. Expanding device according to claim 1 or 2, characterized in that said guiding belts are made of flexible material.

* * * * *